US008070110B2

(12) United States Patent
Jones et al.

(10) Patent No.: US 8,070,110 B2
(45) Date of Patent: Dec. 6, 2011

(54) SINK SUPPORT SYSTEMS

(76) Inventors: Thomas M. Jones, Huntington Beach, CA (US); E. Wayne Lytle, Corona Del Mar, CA (US)

( * ) Notice: Subject to any disclaimer, the term of this patent is extended or adjusted under 35 U.S.C. 154(b) by 0 days.

(21) Appl. No.: 12/250,764

(22) Filed: Oct. 14, 2008

(65) Prior Publication Data

US 2010/0090072 A1 Apr. 15, 2010

(51) Int. Cl.
*G12B 9/00* (2006.01)

(52) U.S. Cl. ..... 248/27.1; 248/201; 248/200.1; 4/633; 4/643

(58) Field of Classification Search ..... 248/201, 248/200.1, 27.1, 214, 172; 4/633, 643, 647, 4/648, 632
See application file for complete search history.

(56) References Cited

U.S. PATENT DOCUMENTS 1,211,182 A * 1/1917 Kruse ..... 248/218.4
2,091,098 A * 8/1937 Hollaender ..... 248/283.1
2,670,915 A * 3/1954 Clark ..... 248/27.1
3,425,655 A * 2/1969 Cogdill ..... 248/343
3,613,177 A * 10/1971 Davis ..... 4/643
4,088,290 A * 5/1978 Novello ..... 248/118
4,122,762 A * 10/1978 Williams ..... 454/292
4,432,106 A * 2/1984 Smith ..... 4/633
5,209,444 A * 5/1993 Rinderer ..... 248/205.1
5,386,959 A * 2/1995 Laughlin et al. ..... 248/205.1
5,505,419 A * 4/1996 Gabrius ..... 248/343
5,538,206 A * 7/1996 Sather ..... 248/27.1
5,653,550 A * 8/1997 Mutz et al. ..... 403/329
5,743,501 A * 4/1998 Rapp ..... 248/201
6,519,791 B2 * 2/2003 Randolph ..... 4/695
6,616,109 B1 * 9/2003 Jarrett et al. ..... 248/201
6,820,290 B1 * 11/2004 Mullick et al. ..... 4/663
7,429,021 B2 * 9/2008 Sather et al. ..... 248/201
7,698,753 B2 * 4/2010 Jones et al. ..... 4/643
2007/0012847 A1 * 1/2007 Tai ..... 248/343
2008/0066226 A1 * 3/2008 Elsinger et al. ..... 4/643
2008/0087778 A1 * 4/2008 Sather et al. ..... 248/201
2008/0196158 A1 * 8/2008 Jones et al. ..... 4/643

* cited by examiner

*Primary Examiner* — Nkeisha Smith
(74) *Attorney, Agent, or Firm* — Larry K. Roberts

(57) ABSTRACT

Exemplary embodiments of sink support systems. An exemplary embodiment includes a cross-member having respective first and second cross-member attachment structures attached at respective ends. First and second mount brackets are configured for attachment to a vertical surface of the support structure. Each of the cross-member attachment structures is configured to engage a corresponding mount bracket to vertically support the cross-member. The cross-member has a plurality of leveling devices to support the sink.

26 Claims, 6 Drawing Sheets

FIG. 7
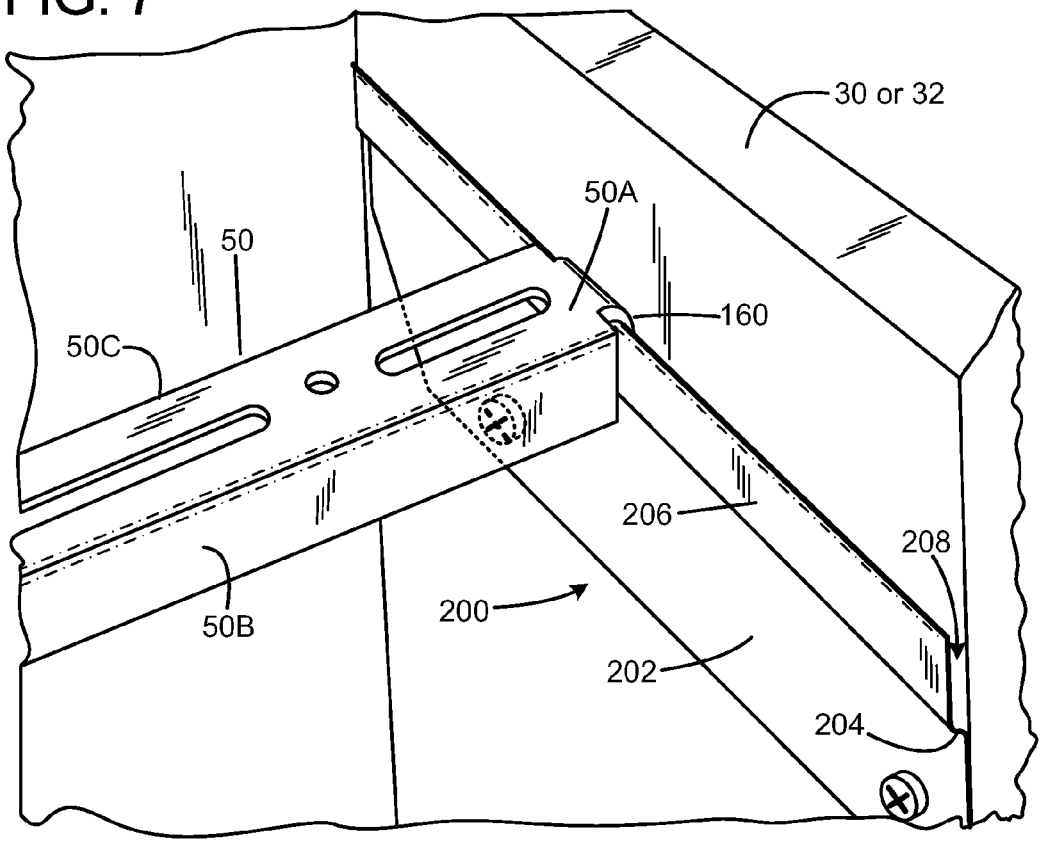
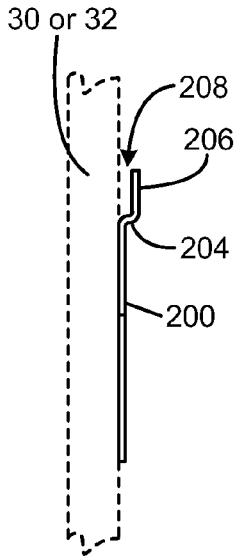
FIG. 9
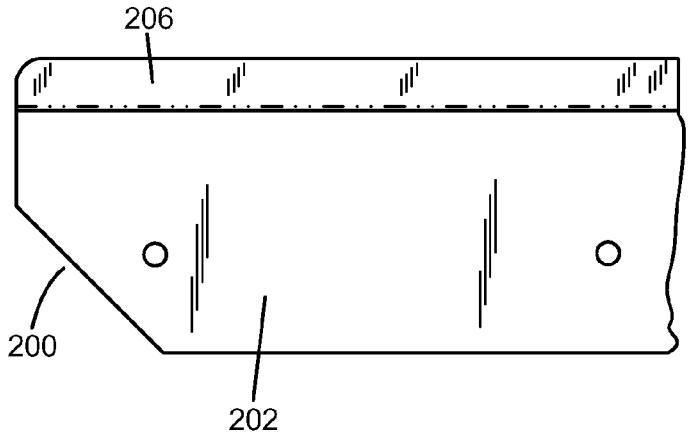
FIG. 8

SINK SUPPORT SYSTEMS

BACKGROUND

Installation of sinks in counters used in kitchens, bathrooms and other facilities can be time consuming. Moreover, there are situations in which it may be desirable to remove the sink after it has been installed, for repair or replacement. The different sink sizes and sink types available to the homeowner or commercial user today present challenges in efficiently mounting the sinks.

BRIEF DESCRIPTION OF THE DRAWINGS

FIG. 7 is an isometric view of a sink support system employing an alternate embodiment of a mount bracket.

FIG. 8 is a partial front plan view of the mount bracket of FIG. 7.

FIG. 9 is a side view of the mount bracket of FIG. 8 with a vertical support shown in phantom line.

DETAILED DESCRIPTION

Figure 1:
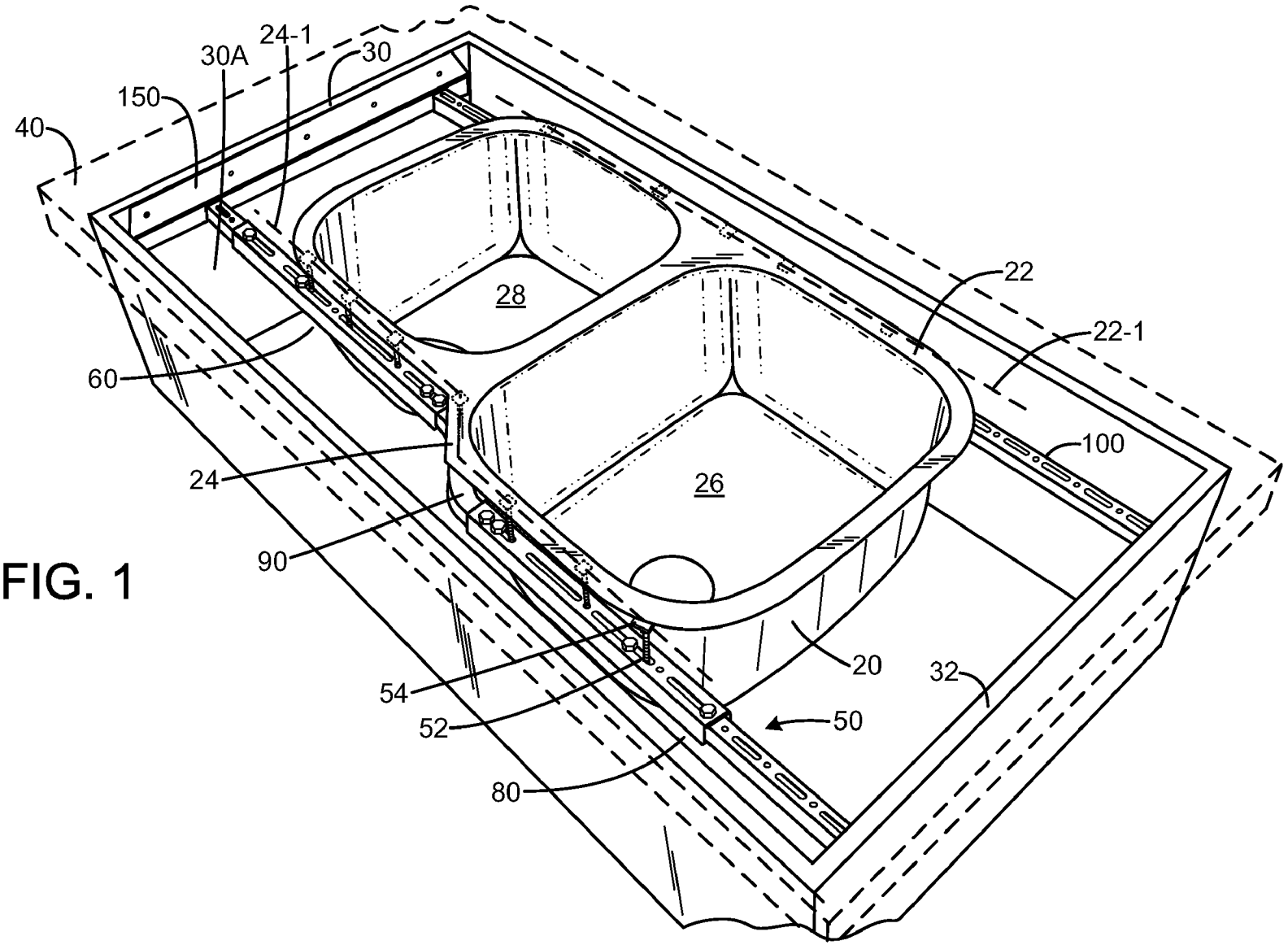
FIG. 1 is an isometric view of an exemplary embodiment of a sink support system to support a sink in a counter.
Figure 2:
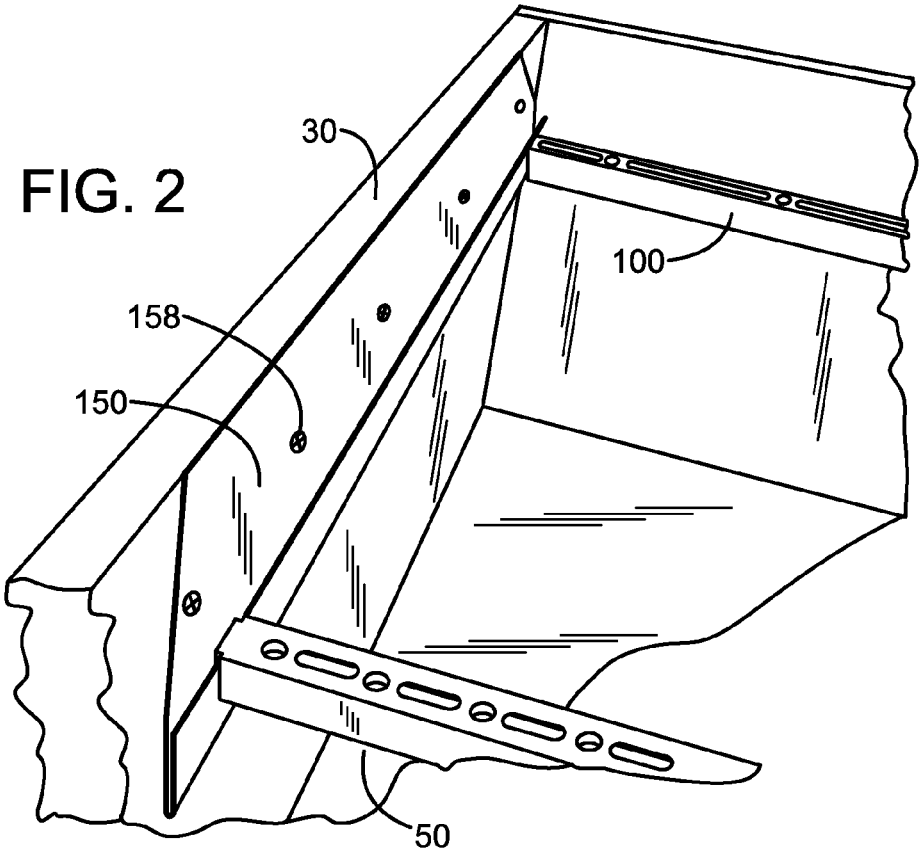
FIGS. 2 and 4 are isometric views illustrating an exemplary embodiment of engagement structures for supporting a cross-member on a mount bracket.

In the following detailed description and in the several figures of the drawing, like elements are identified with like reference numerals. The figures are not to scale, and relative feature sizes may be exaggerated for illustrative purposes.

Exemplary embodiments of sink support systems are described herein, which permit ready installation of sinks to support structures such as cabinets, and which may permit removal of the sink after the sink installation has been completed. In an exemplary form, the sink support system allows ready removal of the sink even after a counter top has been installed around the sink, and without requiring removal of the counter top.

Exemplary sink support systems are described in U.S. Pat. No. 5,538,206, 2008/0196158 and U.S. Pat. No. 7,429,021, the entire contents of which are incorporated herein by this reference.

An exemplary embodiment of the sink support system is illustrated in FIG. 1. The exemplary embodiment includes a cross-member having respective first and second cross-member attachment structures attached at each end. First and second mount brackets are configured for attachment to a vertical surface of the support structure. Each of the cross-member attachment structures is configured to engage a corresponding mount bracket to vertically support the cross-member. The cross-member has a plurality of adjustable leveling devices supported on the support members to support the sink.

In an exemplary embodiment, the cross-member attachment structures and the mount brackets include complementary engagement structures, so that the cross-member may be set in place during installation on the mount brackets, and the cross-member will be supported on the mount brackets. The complimentary engagement structures may include, for example and without limitation, hook and channel structures, hook and eye structures, overlapping channel-like structures, shelf and shoulder structures, to name a few. The sink leveling devices may be actuated or adjusted to fix the sink in position relative to the support structure and/or counter top. If it later becomes necessary to remove the sink, even months or years later, the sink leveling devices may be loosened, and the cross-member removed from engagement with the mount brackets, or in some embodiments, slid on the mount brackets out of the way to allow the sink to be removed.

The exemplary sink setting system is depicted in an exemplary double sink installation in FIG. 1. The system includes two support cross-members 50, 100 which are positioned on opposite sides of a double sink 20. The sink 20 may be fabricated of stainless steel, for example, and in this example, the sink has opposed mounting edges or lips 22, 24. The system may also be used to support sinks fabricated of other materials, such as cast iron or other materials. Mounting edge 22 extends along a linear edge profile 22-1, and may be supported by support cross-member 100. The mounting edge 24 however extends along a non-linear edge profile 24-1. The mounting edge 24 follows the edges of sink basins 26, 28. Basin 28 is shorter or of lesser depth (front to back) than basin 26. The configuration of the sink as a double sink with basins of different sizes is merely exemplary. Aspects of the sink setting system may be employed with single sinks, double sinks with identical basins, cast iron sinks, and virtually any sink configuration.

Figure 13:
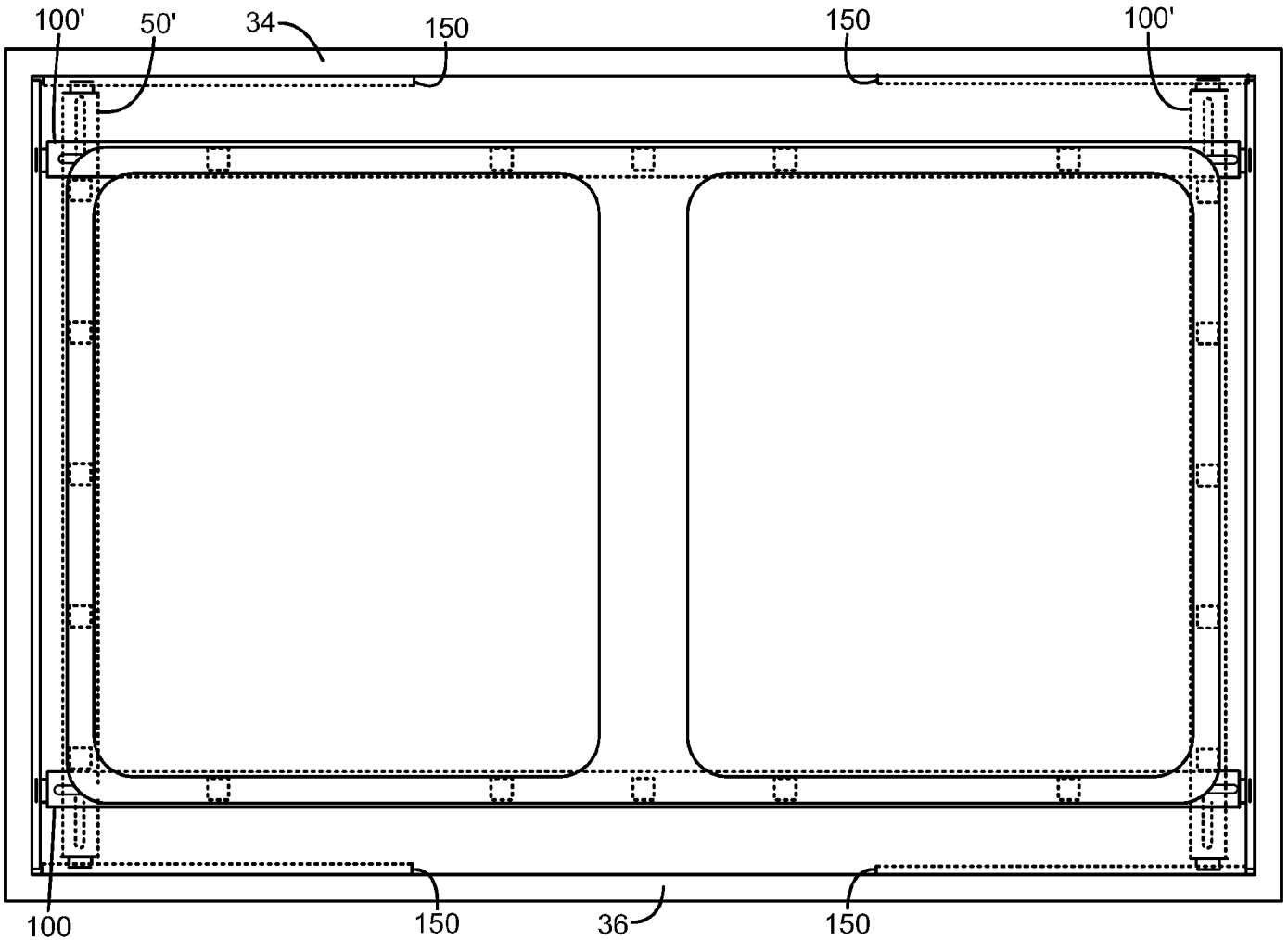
FIG. 13 is a top view showing a sink mounted using cross-members supporting the sink in alternate configurations.

The cross-members 50, 100 are supported by vertical surfaces of structural supports 30, 32, which in an exemplary embodiment may be cabinet walls. The cross-member 100 may be a telescoping cross-member, which is adjustable in length to accommodate sinks of different sizes, and secured in a particular length adjustment by threaded fasteners. One exemplary type of cross-member suitable for the purpose is described in U.S. Pat. No. 7,429,021. Another exemplary cross-member suitable for use as cross-member 100 is described in U.S. Pat. No. 5,538,206. Other cross-support devices may alternatively be employed which employ fixed length, non-telescoping structures or telescoping structures. For situations which do not involve offset sinks such as the sink 20, both cross-members may be linear, i.e. as depicted for cross-member 100. Moreover, the cross-members may be positioned orthogonal to the orientation shown in FIG. 1, i.e. front to back relative to the sink instead of side-to-side. Such a configuration is illustrated in FIG. 13, in which mount brackets 150 are shown as mounted on vertical supports 34 and 36, to support cross-members 100' shown in phantom. FIG. 13 also shows the alternative configuration in which cross-members 150 are mounted in a side-to-side configuration for a double sink.

The sink 20 may be supported by a plurality of leveling bolts 52 and associated end caps 54 which are assembled to the respective cross-members 50, 100. The installer may adjust each of the leveling bolts, e.g. by using a driver tool (from beneath the sink) to turn the bolts in their threaded receptacles to lift the sink lip into tight engagement with the sink opening of the counter top 40 (illustrated in phantom in FIG. 1).

Cross-member 50 in one exemplary embodiment includes first and second telescoping bracket structures 60 and 80, and a connector structure 90. Each of the bracket structures 60 and 80 includes an upper channel member and a lower channel member. The structures 60 and 80 may be fabricated in the same manner, although not necessarily of different lengths. In an exemplary embodiment, the structures 60 and 80 may be of the same length. In another exemplary embodiment, one of the structures 60, 80 may be shorter than the other, to accommodate smaller sink rough opening dimensions.

The cross-members 50 and 100 may include telescoping lower and upper longitudinal channel members. In an exemplary embodiment, the longitudinal members are each of a generally U-shaped construction. In other embodiments, the cross-members may be of a fixed, non-telescoping length, and may be fabricated as a unitary one-piece structure, and may have different cross-sectional configurations from that illustrated, e.g. of a tubular or other configuration. The lower and upper channel members are formed with a web portion connecting leg portions. The web portion of the upper member is wider than the web portion of the lower member, to allow the lower member to nest inside the upper member. The channel members in an exemplary non-limiting embodiment may be fabricated from cold rolled steel; the steel may have a zinc coating applied for corrosion protection. An exemplary thickness of the steel may be 3/16 inch. Other materials and/or thicknesses may alternatively be employed. Further exemplary details of exemplary cross-member structures are described in U.S. Pat. No. 5,538,206, US 2008/0196158 and U.S. Pat. No. 7,429,021.

In an exemplary embodiment, the sink support system further includes a mount bracket or hanger plate, typically one installed at each end of the support structure, to which the cross-members are supported. Thus, in the example shown in FIG. 1, a mount bracket or hanger plate 150 is attached to the vertical surface 30A of support 30, to vertically support the adjacent ends of cross-members 50 and 100, and is not attached to the top (horizontal) surface of the support structure. A similar mount bracket (FIG. 13) is typically also attached to the opposed vertical surface of support 32, to vertically support the opposite adjacent ends of the cross-members.

In an exemplary embodiment, the ends of the cross-members and the mount brackets have complementary engagement structures, so that the cross-member may be set in place during installation on the mount brackets, and the cross-member will be supported on the mount brackets. In some embodiments, the cross-member may be installed on, and removed from, the mount brackets without the use of tools.

An exemplary engagement feature on the mount bracket 150, as illustrated in FIGS. 1-6, is an upturned edge 152 defining an open channel 154. The mount bracket may be fabricated of metal, e.g., galvanized sheet, or sheet steel; the steel may have an anodized, e.g. zinc, coating applied for corrosion protection. The mount bracket may be fabricated of other materials, which may include some plastics, which have sufficient rigidity and strength to support the cross-members and sink. Moreover, the mount bracket may be fabricated by various techniques, including without limitation stamping, casting or molding. In the exemplary embodiment of FIGS. 1-6, the mount bracket has a length dimension larger that the span between the respective cross-members 50, 100 when installed to the support structure. This facilitates the installation of the mount brackets to the vertical support surfaces, since the installer may align the top edge of the bracket to the horizontal, by use of a level, a mark or line drawn on the support surface, or even by the eye of the installer, and secure the bracket to the vertical support surfaces by fasteners 158, e.g. threaded fasteners such as screws for a wood vertical support which pass through preformed holes in the mount bracket. Alternatively the mount bracket may take the form of separate short mount bracket sections, one for each cross-member, so that there is a gap between the mount bracket sections. In an exemplary embodiment, the mount bracket has a height of 3 inches, with a channel (154) depth of about 0.5 inches, although other dimensions may be used.

FIGS. 7, 8 and 9 depict a sink support system employing an alternate embodiment of a mount bracket 200. In this example, the engagement feature of the mount bracket is defined by use of a shoulder or jog 204 formed in the bracket member 202, so that bracket portion 206 extending above the shoulder lies in a different plane from that of the bracket member 202. With the bracket member 200 installed on a vertical surface of a support structure such as 30 or 32, an open channel 208 is defined between the vertical surface and the bracket portion 206. This channel serves as the mount bracket engagement structure for mount bracket 200, into which the corresponding cross-member engagement structure such as 160 can engage. The finger or hook of the cross-member engagement structure can be supported on the top edge of the bracket portion 206, or at the bottom of the channel.

An exemplary embodiment of a cross-member engagement structure is illustrated in FIGS. 1, 2, 4 and 7. The engagement structure includes a downwardly extending finger portion or bracket member 160 (FIGS. 4, 7), protruding from the web portion 50A of the exemplary cross-member 50 to define a right angle bracket with the web portion. The web portion joins downwardly protruding leg portions 50B and 50C. The same cross-member engagement structure may be employed for cross-member 100. Sufficient clearance exists between the finger portion and the end edges of the leg portions to allow the finger portion to be positioned into the channel 154 of the mount bracket 150. The finger portion may be fabricated integrally with the cross-member as a one-piece structure. Alternatively, the engagement structure may be a separate element, attached to the cross-member, e.g. by welding, fasteners, or by a coupling such as a cable or chain. The engagement structures may alternatively constitute other engagement features. For example, hook and eye elements may be employed, e.g. a hook extending from a cable or chain attached to the cross-member, for engagement in an eye of a series of eyes formed in the mount bracket.

Figure 3:
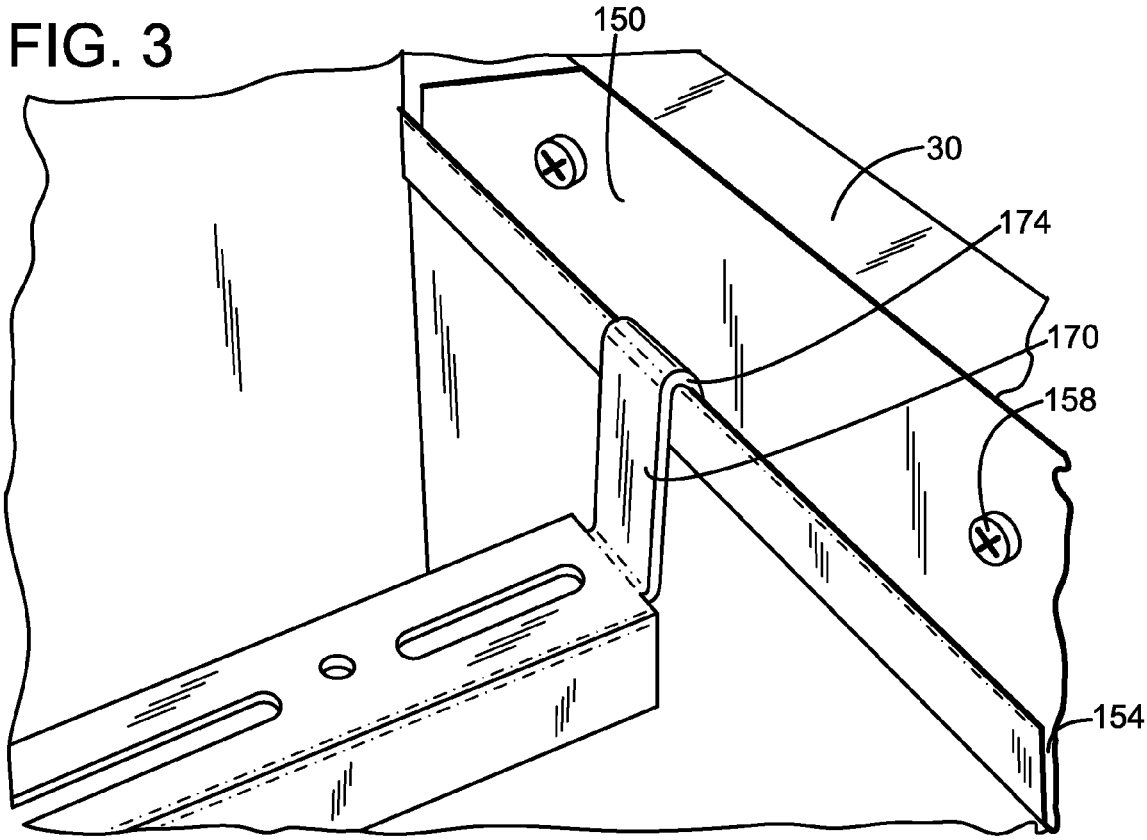
FIG. 3 is an isometric view illustrating an exemplary alternate embodiment of a cross-member engagement structure for supporting a cross-member on a mount bracket.
Figure 4:
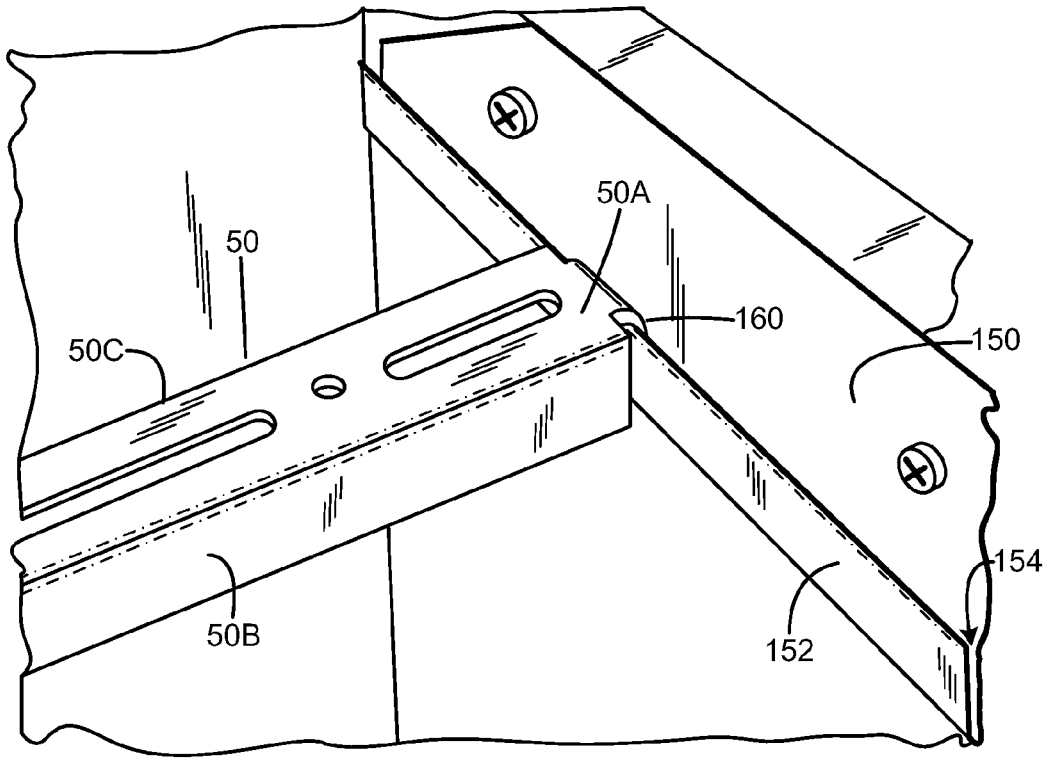
Figure 6:
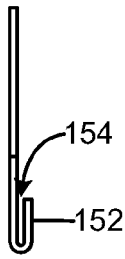
FIG. 6 is a side view of the exemplary embodiment of the mount bracket of FIG. 5.
Figure 5:
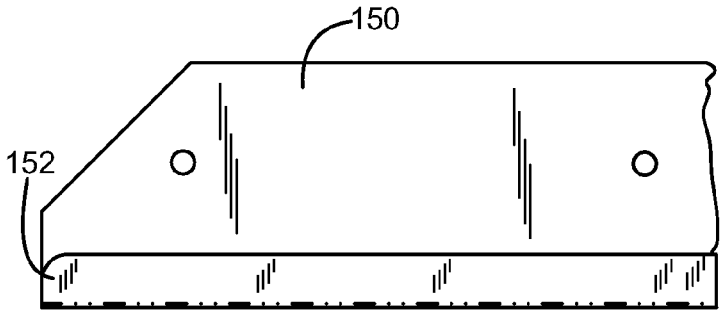
FIG. 5 is a partial front plan view of an exemplary embodiment of a mount bracket for the system of FIG. 1.
Figure 10:
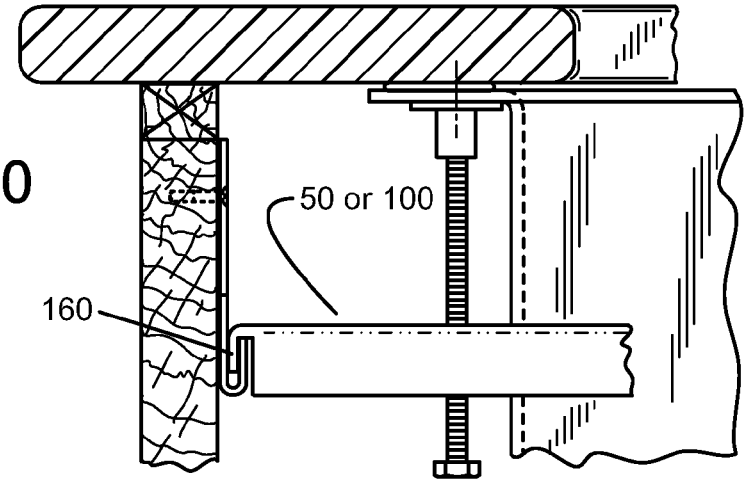
FIG. 10 is a partial side view, illustrating the exemplary engagement structures of FIGS. 2 and 4 in use to support a sink, and with a leveling bolt.
Figure 11:
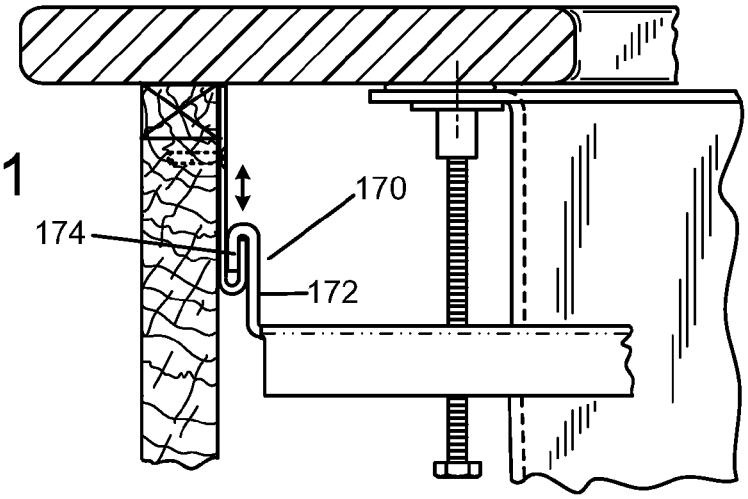
FIG. 11 is a partial side view, illustrating the exemplary engagement structure of FIG. 3 in use to support a sink, and with a leveling bolt.
Figure 12:
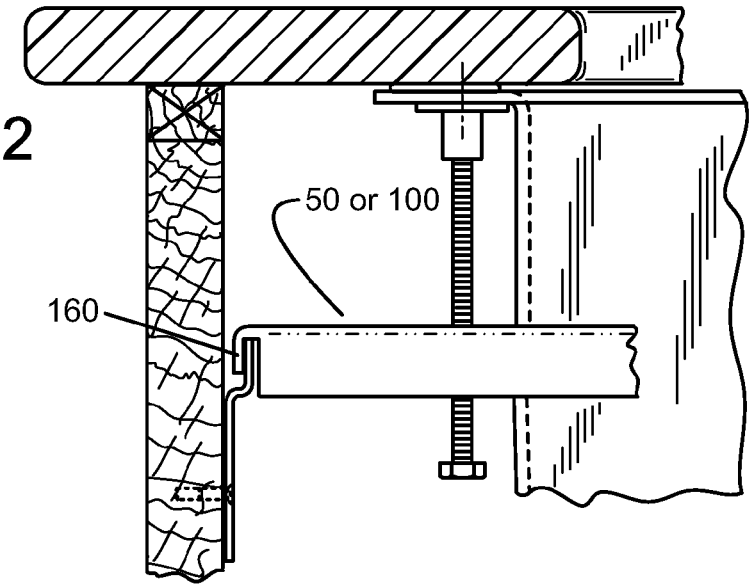
FIG. 12 is a partial side view, illustrating the exemplary alternate embodiment of a mount bracket as in FIGS. 7-9.

One exemplary alternate embodiment of a cross-member engagement structure is illustrated in FIG. 3. In this example, the engagement structure is a generally right angle bracket element, or strap portion 170, with the end portion 174 bent over to define a hook. The hook has a gape sufficient to allow the end portion to be positioned into the channel 154 of the mount bracket 150. In an exemplary embodiment, the strip portion 170 extends upwardly at a right angle from the web portion of the cross-member. The strip portion 170 may be fabricated as a unitary structure with the web portion of the cross-member.

Exemplary embodiments of the sink support system provide one or more of the following advantages. Installation of the sink support system is simplified, saving the installer time, since the mount brackets or side plates can be easily installed on the vertical surfaces of the support structures, by marking a known distance from the top edge, aligning the top straight edge of the side plate with the mark and securing the side plate to the vertical surface, e.g. using wood screws passed through preformed apertures in the side plate. It is not necessary to prepare the top horizontal edge of the support structure, e.g. by routing out a recess to receive a mount bracket formed on the cross-member. In the case in which the side plates have a substantial longitudinal extent (i.e. in a horizontal direction), the installer may not have to make accurate measurements to determine just where the cross-member brackets will be secured along the horizontal direction, if (as in the embodiment of FIG. 1) the engagement structure on the side plate extends along the horizontal direction to provide a continuous range of positions in which the cross-member may be attached to the side plate.

Another advantage which may be provided is the capability of the system to allow the sink to be removed after the installation has been completed from the support structure, even in the case in which the counter top has been installed, which typically prevents the sink from being lifter out through the sink opening in the counter top or support structure. The sink may be removed by loosening the leveling bolts so that the caps on the tops of the bolts no longer are in contact with the lip of the sink. The cross-member may then either be removed, by disengaging the attachment structure on the cross-member from the mount bracket, e.g. by lifting the end of the cross-member, or slid on the mount bracket away from the sink until the sink may be dropped down without interference with the cross-member.

Although the foregoing has been a description and illustration of specific embodiments of the subject matter, various modifications and changes thereto can be made by persons skilled in the art without departing from the scope and spirit of the invention.

What is claimed is:

1. A sink support system for mounting a sink to a support structure, comprising:

at least one cross-member comprising a first cross-member having respective first and second cross-member attachment structures attached at each end, the at least one cross-member having a sink adjusting system for adjusting a height of the sink supported thereon and supporting the sink in a fixed installation position with the sink adjusting system in an actuated condition, the sink being prevented from movement while the sink adjusting system is in the actuated condition;

first and second mount bracket sections configured for attachment to opposed vertical surfaces of the support structure, each of the first and second mount bracket sections including an engagement structure which extends along a horizontal direction in a mount location to provide a range of positions for attachment of a corresponding cross-member attachment structure;

each of the cross-member attachment structures configured to engage a corresponding engagement structure of a corresponding mount bracket section to vertically support the at least one cross-member and the sink with the sink adjusting system in the actuated condition, while permitting movement of the cross-member attachment structures in a generally horizontal direction while the sink support system is not actuated to support the sink in the fixed installation position to allow adjustment in a position of the at least one cross-member along the horizontal direction during sink installation and during sink removal; and wherein said mount bracket sections, said at least one cross-member and said sink adjusting system are cooperatively configured to permit removal of an installed sink after installation of a counter top on the support structure and without removal of the counter top, by configuring the sink adjusting system in a non-actuated condition in which the sink adjusting system does not support the sink in the fixed installation position, and moving the at least one cross-member away from the sink so that the sink adjusting system and said at least one cross-member do not interfere with removal of the sink in a generally downward direction, and thereafter permitting re-installation of a sink using said sink support system.

2. The system of claim 1, wherein the sink adjusting system comprises a threaded hole disposed in the at least one cross-member with an adjustment screw threaded into the threaded hole, the adjustment screw oriented to support the sink vertically in said installation position when the cross-member attachment structures are mounted to the mount bracket sections.

3. The system of claim 2, wherein a cap is disposed on an end of the adjustment screw.

4. The system of claim 1, wherein the cross-member attachment structures are cooperatively configured with the engagement structures of the mount bracket sections such that the cross-member attachment structures are constrained from downward movement, but are free to move upwardly and along the horizontal direction while the sink support system is not actuated to support the sink in the fixed installation position, to permit disengagement of the cross-member attachment structures from the mount bracket sections.

5. The system of claim 1, wherein each engagement structure of each mount bracket section includes a channel, and each cross-member attachment structure includes an extending finger member configured to be received in said channel.

6. The system of claim 5, wherein the at least one cross-member has a general U-shape along a longitudinal axis.

7. The system of claim 6, wherein the finger member extends downwardly from a web portion of the at least one cross-member connecting downwardly extending leg portions.

8. The system of claim 6, wherein the finger member extends from a vertical support portion extending upwardly from a web portion.

9. The system of claim 1, wherein the cross-member attachment structures are cooperatively configured with the mount bracket sections such that the at least one cross-member may be set in place during installation on the mount bracket sections, and the at least one cross-member is supported on the mount bracket sections.

10. The system of claim 8, in which the at least one cross-member may be installed on the mount bracket sections without any use of tools.

11. The system of claim 1, wherein the at least one cross-member further comprises a second cross-member, and the system further comprises a third mount bracket section and a fourth mount bracket section, said first cross-member and said second cross-member each having a corresponding engagement structure and configured to support the sink on opposite sides of the sink in a spaced arrangement separated by a sink span distance.

12. The system of claim 11, wherein said first mount bracket section and said third mount bracket section are formed as a single integral bracket structure having a longitudinal extent greater than the sink span distance.

13. The system of claim 12, wherein said integral bracket structure has a top linear straight edge.

14. A device for mounting a sink with a counter, comprising:

a cross-member comprising first and second support members having respective two overlapping ends and two opposed distal ends wherein each of said distal ends having a connecting portion, wherein the two overlapping ends are rigidly connected by a nut and bolt attached through the two overlapping ends having holes defined therein, the cross-member having a U-shape along its longitudinal axis;

one of said connecting portions having an attach structure and a mount bracket having a mount surface configured for attachment to a vertical surface of a counter support structure, the mount bracket including an engagement structure which extends along a horizontal direction in a mount location to provide a range of positions for attachment of the attach structure of the cross-member;

wherein the attach structure is cooperatively configured with the engagement structure of the mount bracket such that the attach structure may be set in place during installation on the mount bracket, and one of said distal ends is supported on the mount bracket while permitting movement of the attach structure in a generally horizontal direction to provide a continuous range of positions in which the cross-member is attached to the mount bracket;

the cross-member having a sink adjusting means for adjusting a height of the sink supported thereon, comprising a threaded hole disposed in the cross-member with an adjustment screw threaded into the threaded hole wherein the adjustment screw is oriented to support the sink vertically when the attach structure is engaged with the mount bracket and supports the sink in a fixed installation position with the sink adjusting means in an actuated condition, the sink being prevented from movement while the sink adjusting means is in the actuated condition; and wherein said mount bracket, said cross-member and said sink adjusting means are arranged to permit removal of an installed sink after installation of a counter top on the support structure and without removal of the counter top, by loosening the adjustment screw and moving the cross-member away from the sink so that the sink adjusting means and said cross-member do not interfere with removal of the sink in a generally downward direction, and thereafter permitting re-installation of a sink.

15. The device of claim 14, wherein the attach structure includes a downwardly extending finger portion, and the engagement structure of the mount bracket includes an interlocking channel for receiving the finger portion to vertically support the cross-member.

16. The system of claim 1, further comprising:

a plurality of threaded fasteners for attaching the first and second mount bracket sections to said opposed vertical surfaces.

17. The system of claim 1, further comprising:

a plurality of threaded fasteners for attaching the mount bracket sections to said vertical surfaces.

18. A system for mounting a sink to a support structure, the system comprising:

first and second cross-members configured to support the sink on opposite sides of the sink, each cross-member including first and second support members, the first support member having a first bracket portion at a bracket end thereof, the second support member having a second bracket portion at a bracket end thereof;

the first and second support members of each of the first and second cross-members adapted for fitting together along a range of positions to provide a variable length sink support system;

a plurality of leveling devices supported on the support members to support the sink in a fixed installation position in an actuated condition, the sink being prevented from movement with the plurality of leveling devices in the actuated condition;

at least one fastening device for fastening said first and second support members together at a position in said range of positions;

first and second mount brackets, each configured for attachment to a vertical surface of the support structure and including an engagement structure which extends along a horizontal direction in a mount location to provide a range of positions to interlock with one of the first and second bracket portions to vertically support a corresponding support member while permitting movement of the first and second cross-members in a generally horizontal direction only while the leveling devices are not in the actuated condition supporting the sink; and wherein said engagement structures of said mount brackets, said cross-members and said plurality of leveling devices are arranged to permit removal of an installed sink after installation of a counter top on the support structure and without removal of the counter top, by loosening the leveling devices and moving at least one of the cross-members away from the sink so that the leveling devices and at least one of the cross-members do not interfere with removal of the sink in a generally downward direction, and thereafter permitting re-installation of a sink using said system.

19. The system of claim 18, wherein the bracket portions and the engagement structures of the mount brackets include complementary engagement structures, so that the first and second cross-members may be set in place during installation on the mount brackets, and the cross-members supported on the mount brackets.

20. The system of claim 18, wherein said first and second mount brackets have a longitudinal extent in a horizontal direction sufficient to support said bracket ends of each of said first and second support members in a sink installation.

21. The system of claim 20, wherein said first and second mount brackets have a top linear straight edge to facilitate horizontal alignment.

22. The system of claim 18, wherein said mount brackets, said support members and said leveling devices are arranged to permit removal of an installed sink by loosening the leveling devices and moving at least one of the support members away from the sink so that the leveling devices do not interfere with removal of the sink in a generally downward direction.

23. The system of claim 18, further comprising:

a plurality of threaded fasteners for attaching the first and second mount brackets to said vertical surfaces.

24. A system for mounting a sink to a support structure, the system comprising:

first and second cross-members configured to support the sink on opposite sides of the sink, each cross-member including first and second support members, the first support member having a first bracket portion at a bracket end thereof, the second support member having a second bracket portion at a bracket end thereof;

the first and second support members of each of the first and second cross-members adapted for fitting together along a range of positions to provide a variable length sink support system;

a plurality of leveling devices supported on the support members to support the sink in a fixed installation position in an actuated condition;

at least one fastening device for fastening each of said first and second support members together at a position in said range of positions;

first and second mount brackets, each configured for attachment to opposed vertical surfaces of the support structure and defining an upturned edge spaced from a corresponding vertical surface, and wherein the first and second bracket portions are configured to removably engage the upturned edges to vertically support a corresponding support member while permitting movement of a corresponding cross-member in a generally horizontal direction only while the leveling devices are not in the actuated condition supporting the sink to provide a continuous range of positions in which the cross-members are supported on the mount brackets along the upturned edges wherein said mount brackets, said support members and said leveling devices are arranged to permit removal of an installed sink after installation of a counter top on the support structure and without removal of the counter top, by loosening the leveling devices and moving at least one of the cross members away from the sink so that the leveling devices and said at least one of the cross members do not interfere with removal of the sink in a generally downward direction, and thereafter permitting re-installation of a sink using said system.

25. The system of claim 24, wherein said upturned edges of the first and second mount brackets when installed on said vertical support surfaces have a longitudinal extent in a generally horizontal direction sufficient to support said bracket ends of each of said first and second cross-members in a sink installation.

26. The system of claim 24, wherein said upturned edges have a longitudinal extent exceeding a width of each cross-member bracket portion to provide a continuous range of positions in which the cross-members are supported on the mount brackets.

* * * * *